US007097160B2

(12) United States Patent
Nelson

(10) Patent No.: US 7,097,160 B2
(45) Date of Patent: Aug. 29, 2006

(54) APPARATUS FOR TREATING A LIQUID WITH A GAS

(75) Inventor: William R. Nelson, Poulsbo, WA (US)

(73) Assignee: Ozone Safe Food, Incorporated, Palm Springs, CA (US)

( * ) Notice: Subject to any disclaimer, the term of this patent is extended or adjusted under 35 U.S.C. 154(b) by 132 days.

(21) Appl. No.: 10/964,100

(22) Filed: Oct. 13, 2004

(65) Prior Publication Data

US 2006/0076696 A1 Apr. 13, 2006

(51) Int. Cl.
*B01F 3/04* (2006.01)

(52) U.S. Cl. ..... 261/29; 261/65; 261/79.2; 261/DIG. 42

(58) Field of Classification Search ..... 261/29, 261/36.1, 65, 79.2, 121.1, 126, DIG. 42; 210/760, 188, 194
See application file for complete search history.

(56) References Cited

U.S. PATENT DOCUMENTS 1,213,887 A * 1/1917 Krause ..... 159/48.1
2,653,801 A * 9/1953 Fontein et al. ..... 366/139
3,124,518 A * 3/1964 Guzman et al. ..... 196/46
4,040,973 A * 8/1977 Szivos et al. ..... 588/20
4,072,613 A * 2/1978 Alig ..... 210/198.1
5,865,995 A 2/1999 Nelson
5,968,352 A * 10/1999 Ditzler ..... 210/220
6,054,046 A * 4/2000 Nelson ..... 210/194
6,264,174 B1 * 7/2001 Chang et al. ..... 261/29
6,361,688 B1 3/2002 Nelson
6,464,210 B1 * 10/2002 Teran et al. ..... 261/79.2
6,773,610 B1 * 8/2004 Korin ..... 210/748
6,808,637 B1 * 10/2004 Cho ..... 210/744
6,955,341 B1 * 10/2005 Liou ..... 261/64.1

* cited by examiner

*Primary Examiner*—Scott Bushey
(74) *Attorney, Agent, or Firm*—Greenebaum Doll & McDonald PLLC; Glenn D. Bellamy

(57) ABSTRACT

The present invention includes an improved apparatus (10) for treating a liquid with a gas having a generally cylindrical outer housing (24) and a coaxial inner housing (40) defining both an outer and an inner chamber (26, 46) and a plurality of inlets (70, 80) for introducing a fluid and a gas therein to generate a helical current throughout both chambers (26, 46). The present invention further includes a re-circulated fluid outlet (100) and a primary fluid outlet (104) for removing mixed fluid and gas that is disposed radially outwardly in a bottom portion of the inner chamber (46).

12 Claims, 4 Drawing Sheets

WATER TO BE RECIRCULATED
PUMP
WATER OUT
LATED WATER INLET
VENTURI/NAZZEI
106
104
100
162
130
72
50,60

90
22
28
20
98
94
42
40
74'
80
74
10
24
26
46
2

50
100
104
119
RECIRCULATED WATER INLET
122
126
OZONE INLET
132
72
102
130
WATER FROM SOURCE
106
WATER OI

APPARATUS FOR TREATING A LIQUID WITH A GAS

CROSS REFERENCE TO RELATED APPLICATIONS

The present invention is an improvement on the invention disclosed and claimed in U.S. Pat. No. 6,361,688 entitled "Treating a Liquid with a Gas", the entirety of which is incorporated herein by reference.

TECHNICAL FIELD

The invention disclosed and claimed herein relates generally to systems for combining a gas with a liquid to produce a usable gas/liquid mixture, and relates specifically to a system for combining ozone with water to provide a usable ozone/water mixture for cleaning and sanitizing while re-circulating a portion of the liquid/gas mixture for additional mixing prior to the use thereof.

BACKGROUND OF THE INVENTION

In many prior art systems of mixing gasses and liquids, a gas is introduced into a liquid whereupon the gas/liquid mixture is forced to flow downwardly as a helical current through an outer chamber of a contact tank to a lower end thereof, and then back up through a center tube that extends upwardly from a lower region of the contact tank to an outlet conduit at the upper end of the contact tank. In the system taught in U.S. Pat. No. 5,865,995, the gas is introduced into a stream of untreated liquid and then the mixture is introduced into the contact tank. Some of the gas/liquid mixture in the contact tank is re-circulated and new gas is introduced into the re-circulated mixture. Furthermore, new untreated liquid is introduced by itself into the upper end of the contact tank.

Furthermore, in some prior art systems a gas/liquid mixture is introduced into a lower portion of an outer chamber in such a way that it forms an upwardly flowing helical current in the outer chamber. A gas removal outlet is provided in an inner chamber defined by an inner housing, radially inwardly of and axially below a passageway at the top of the inner housing that connects the outer chamber with the inner chamber. A liquid outlet conduit is provided below a bottom wall of the inner housing. An outlet in the bottom wall of the inner housing connects the lower end of the inner chamber to the outlet conduit.

Additionally, in some prior art systems the lower portion of the outer housing is often formed to include an inlet chamber. The gas/liquid inlet conduit is directed to discharge into the inlet chamber at a tangent thereby producing the helical current and enabling efficient mixing of the distinct phases. Furthermore, the lower portion of the outer housing may also include an outlet conduit.

There is a need in the prior art systems for an improved apparatus for treating a liquid with a gas wherein the helical current provides for efficient mixing of the two phases and wherein the less efficiently mixed portions are withdrawn from the apparatus for recirculation and reintroduction thereto. Often the mixture of gas and liquid produced by prior art devices is not sufficiently homogeneous to produce efficacious results. The need for even mixing is particularly acute when the gas/liquid mixture is, for example, ozone gas mixed with water which is commonly used as a cleaning and sanitizing agent in a wide variety of industrial applications.

SUMMARY OF THE INVENTION

The aforementioned problems are addressed by the apparatus of the present invention which provides an improved means for treating a liquid with a gas to produce a homogeneous liquid/gas mixture. The apparatus includes an outer housing that is generally cylindrical in shape having a sidewall, a top end and a bottom end, and a generally cylindrical inner housing disposed within the outer housing, having a sidewall, a bottom and an open top spaced below the top end of the outer housing.

The outer housing and the coaxially disposed inner housing are typically oriented with their central axes aligned substantially vertically. An outer chamber is defined by and between the respective sidewalls of the coaxial inner and outer housings. An inner chamber, open at a top end thereof, is defined by the sidewalls and bottom of the inner housing. The upper end of the outer chamber is in fluid communication with the upper end of the inner chamber proximate an upper end portion of the sidewall of the inner housing.

A gas/liquid mixture is introduced into a lower portion of the outer chamber through an inlet, such that it produces an upwardly flowing helical current in the outer chamber. A gas removal outlet is provided in the inner chamber, radially inwardly of and axially below the top of the inner housing. Additionally, a first liquid outlet is provided in the bottom of the inner housing, near the central axis of the housing, for withdrawing fluid for re-circulation and further mixing. A second liquid outlet in the bottom of the inner housing disposed radially outwardly of the first outlet provides for the outward flow of the homogeneously mixed gas/liquid mixture for end use.

In the present invention, an improved means of circulation for the gas/liquid mixture is provided, wherein a more homogeneous mixture is produced for end use. Additionally, and in accordance with a constructed embodiment of the present invention, first and second fluid outlets are provided in the bottom of an inner chamber wherein a first fluid outlet is used to withdraw and re-circulate a portion of the gas/fluid mixture and a second outlet withdraws the gas/fluid mixture for end use. The second fluid outlet is positioned proximate the side wall of the inner chamber such that the gas and fluid withdrawn therethrough is thoroughly mixed by the vortex motion of the fluid and gas circulating through the inner chamber. The position of the second fluid outlet being radially outward of the central axis of the inner chamber permits the withdrawal for end use of fluid that is swirling helically at a greater velocity than fluid nearer the center of the inner chamber, thereby providing more homogeneously mixed fluid to be withdrawn from the second fluid outlet.

In accordance with one embodiment of the present invention, the apparatus further includes a re-circulating pump having a fluid inlet and a fluid outlet. A conduit connects the re-circulated fluid supplied via the first outlet with the inlet of the re-circulating pump. Another conduit connects the outlet of the re-circulating pump with a gas and liquid mixing region.

A gas delivery conduit is in fluid communication with the conduit that extends from the outlet of the pump to the gas and liquid mixing region, for introducing new gas into the re-circulated fluid/gas mixture. Additionally, an untreated liquid conduit is in fluid communication with the gas and liquid mixing region. In this fashion, the re-circulated gas/liquid mixture, new gas and untreated liquid are all combined in the gas and liquid mixing region to form a gas/liquid mixture that is then delivered through the gas/liquid inlet into a lower portion of the outer chamber.

In accordance with one embodiment of the present invention, an ejector may be provided in the re-circulated gas/liquid conduit. Flow of the re-circulated gas/liquid mixture through the ejector draws in some new gas that is added to and is mixed with the re-circulated gas/liquid flow.

According to a further aspect of the invention, a gas-vent having enclosed in a housing is secured in the top end of the outer housing. This gas-vent housing extends downwardly from the top end wall into the inner chamber, and is generally concentric therewith. The gas-vent housing has a sidewall that is spaced radially inwardly from an upper portion of the sidewall of the inner housing and a bottom wall. The gas vent housing includes one or more openings in this bottom wall for drawing unmixed gas from the top of the inner chamber. The gas-vent housing may include a passageway leading from the one or more openings in its bottom wall, up through the gas-vent housing, and on out through an exhaust opening. The gas-vent housing may be further provided with a float controlled valve in this passageway which is normally open but is adapted to be closed by the float in response to liquid from the inner chamber rising in the gas-vent housing to a predetermined level. The rising liquid lifts the float and closes a valve in the gas-vent passageway to prohibit fluid egress through the gas vent.

According to a further embodiment of the present invention, at least one secondary fluid inlet is positioned in fluid communication with the inner or outer chambers to deliver a portion of the incoming liquid and gas in such a fashion as to enhance the helical current flow through the entire system.

The present invention increases gas exposure to the liquid by enhancing contact time between the liquid and the treatment gas as the constituents circulate upwardly through the outer chamber thence downwardly through the inner chamber, as well as providing efficient gas removal from the liquid after the treatment.

The present invention provides an apparatus for treating a liquid with a gas that may be relatively compact and may be simple to construct by modern manufacturing techniques, and simple to maintain thereafter.

Also, the present invention provides an apparatus for treating a liquid with a gas that may enhance the homogeneity of the liquid gas mixture, that may utilize a helical current within a plurality of fluid chambers to mix the liquid with the gas, and/or that may employ an additional fluid and gas inlet to enhance the helical current therein.

Additional advantages, features and objects of the invention will be apparent from the detailed description of the preferred embodiments, the drawing figures, and the claims included herein below.

BRIEF DESCRIPTION OF THE DRAWING FIGURES

Like reference numerals are used to indicate like parts throughout the drawing figures, and:

DETAILED DESCRIPTION OF EMBODIMENT(S) OF THE INVENTION

Figure 2:
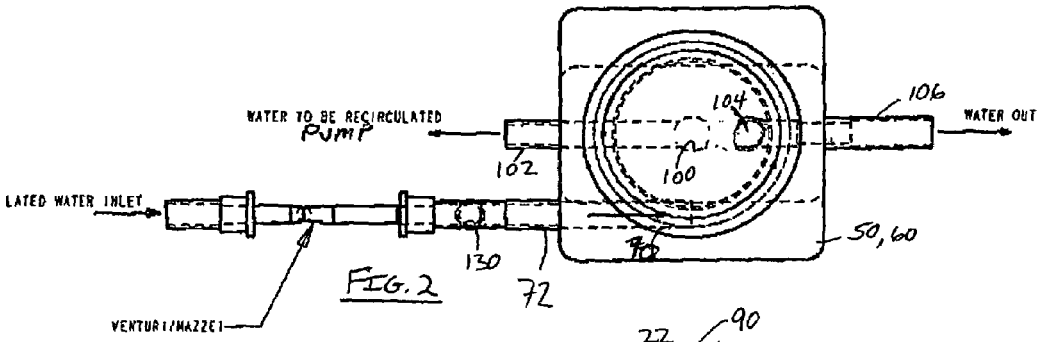
FIG. 2 is a view of the present invention taken along the line 2—2 of FIG. 1.
Figure 1:
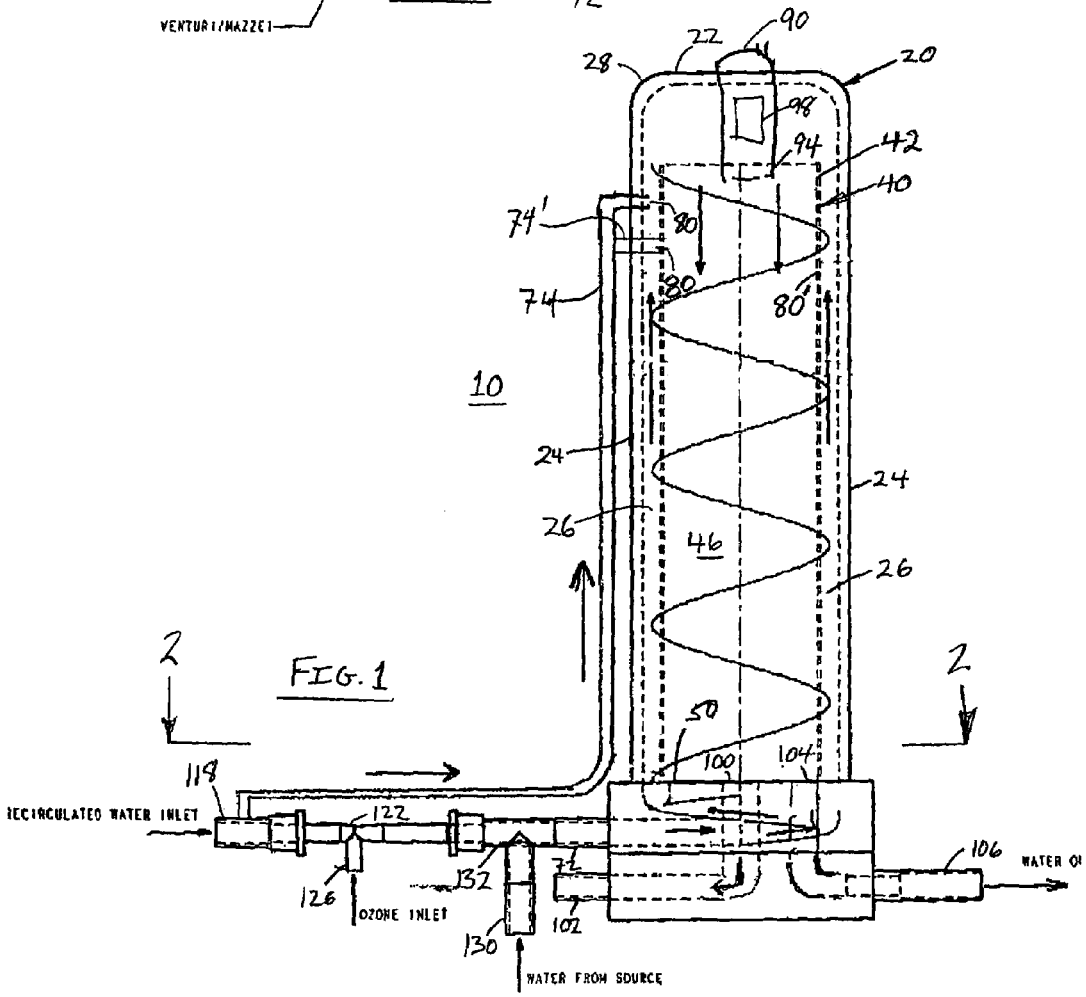
FIG. 1 is an elevational view of a liquid treatment system in accordance with one embodiment of the present invention.

Referring now to drawing FIGS. 1 and 2, and in accordance with a constructed embodiment of the present invention, an apparatus 10 for treating a liquid with a gas comprises a generally cylindrical outer housing 20 oriented such that its central axis is substantially vertical, and a generally cylindrical inner housing 40 disposed coaxially within the outer housing 20. Both the outer 20 and inner 40 housings have a bottom 50, which may be formed as an integral part of a base 60. Furthermore, the outer housing 20 includes a top 22 that provides containment of the liquid and gas being mixed.

The inner housing 40 is open at a top portion 42 thereof, and the cylindrical side wall 44 of the inner housing 40, in conjunction with the bottom 50, define an inner chamber 46 that is open at the top. A space between the side wall 44 of the inner housing 40 and a side wall 24 of the outer housing 20 define an outer chamber 26 that is generally annular in shape and is in fluid communication with the inner chamber 46 at the top portion 42 of the inner housing 40.

A liquid and gas mixture is delivered into a lower portion of the outer chamber 26 via first fluid inlet 70 disposed in the bottom 50. The first inlet 70 is connected to a source of gas and liquid (not shown) via a supply conduit 72 wherein the gas and liquid to be mixed are introduced under pressure into said supply conduit 72. Various systems for supplying pressurized gas and liquid are well known to one of ordinary skill in the art, as disclosed in the prior art references discussed herein above. Note that the gas and liquid used may be ozone and water, but any suitable gas and liquid required to be mixed may be employed in the present invention.

The first fluid inlet 70 is oriented in the bottom 50 so as to direct the fluid flowing into the outer chamber 26 in a generally circumferential direction around the outer chamber 26, thereby initiating a helical current that flows both upwardly and circumferentially through the outer chamber 26.

A secondary fluid inlet 80 may be provided in side wall 24 of the outer chamber 20 to supply a portion of the liquid and gas mixture flowing through supply conduit 72 via a second supply conduit 74 that is in fluid communication with supply conduit 72. The secondary fluid inlet 80 is disposed in side wall 24 of the outer chamber 20 proximate an upper portion thereof, and is oriented to direct the fluid entering the outer chamber 26 in a generally circumferential direction around the outer chamber 26, thereby enhancing both the velocity and direction of the helical current flowing in the outer chamber 26.

In an alternative embodiment of the present invention as shown in FIG. 1, the secondary fluid inlet 80 is disposed in the side wall 44 of the inner housing 40 to further enhance the helical current flow through the inner chamber 46. In this embodiment of the present invention, the second supply conduit 74 is routed through the side wall 24 of the outer housing 20 whereupon it terminates at the secondary fluid inlet 80.

It should be noted that the secondary fluid inlet 80 can be oriented to direct the fluid entering either the outer chamber 26 or (at 80') the inner chamber 46 upwardly or downwardly as well as circumferentially, in order to further enhance the helical current formation in the respective chambers. In other words the secondary fluid inlet 80 is oriented to impart a direction to the fluid entering a chamber in order to enhance the desired degree of helical current therein. The stronger helical current promotes a more homogeneous mixture of gas and liquid at the point of withdrawal from the apparatus, as will be described in greater detail herein below.

In a yet further embodiment of the present invention a plurality of secondary fluid inlets 80, 80' may be enter the side wall 24 of the outer housing 20 and the side wall 44 of the inner housing 40 at a plurality of locations to further strengthen the helical current flow throughout the inner and outer chambers 46 and 26 respectively. Each of the secondary fluid inlets 80, 80' is disposed to direct the fluid flow therethrough in a direction to enhance the helical current flow in the inner or outer chambers 46 and 26.

Figure 4:
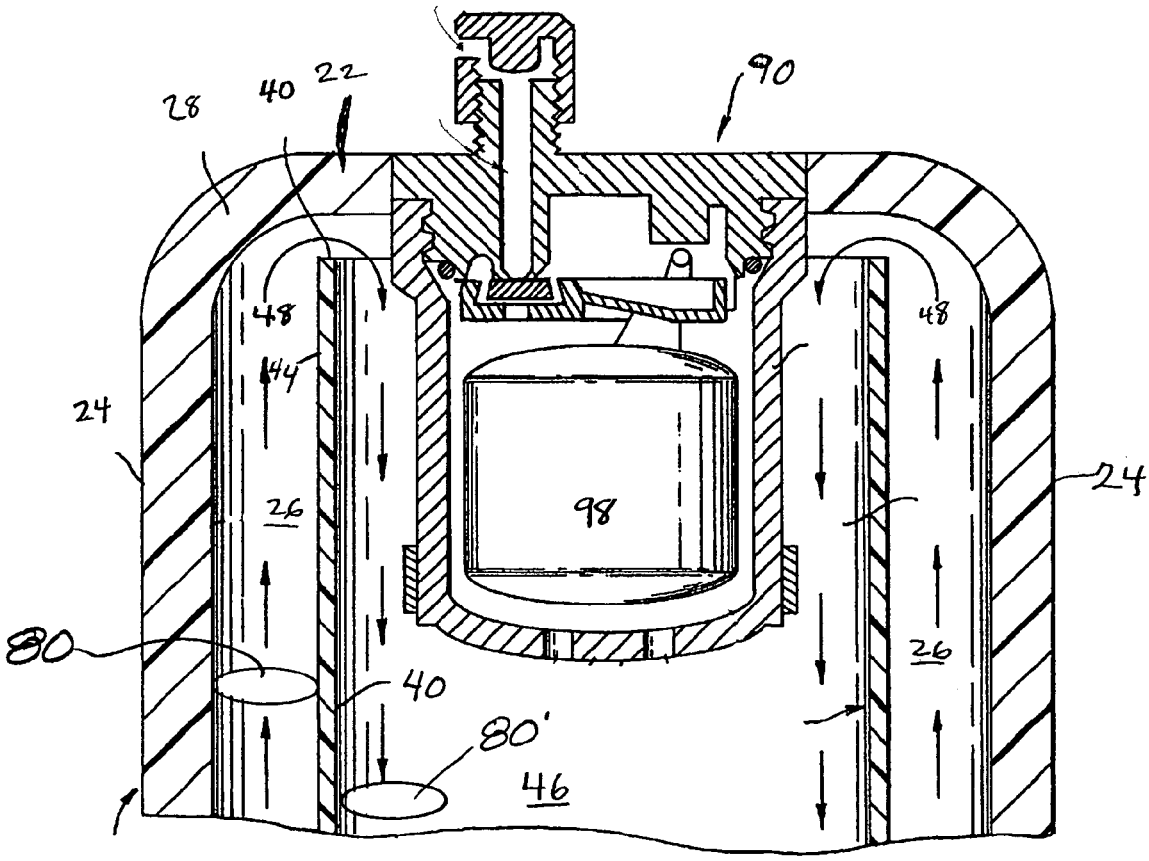
FIG. 4 is an enlarged scale fragmentary sectional view of an outer and inner housing at a top end thereof, in accordance with one embodiment of the present invention.
Figure 5:
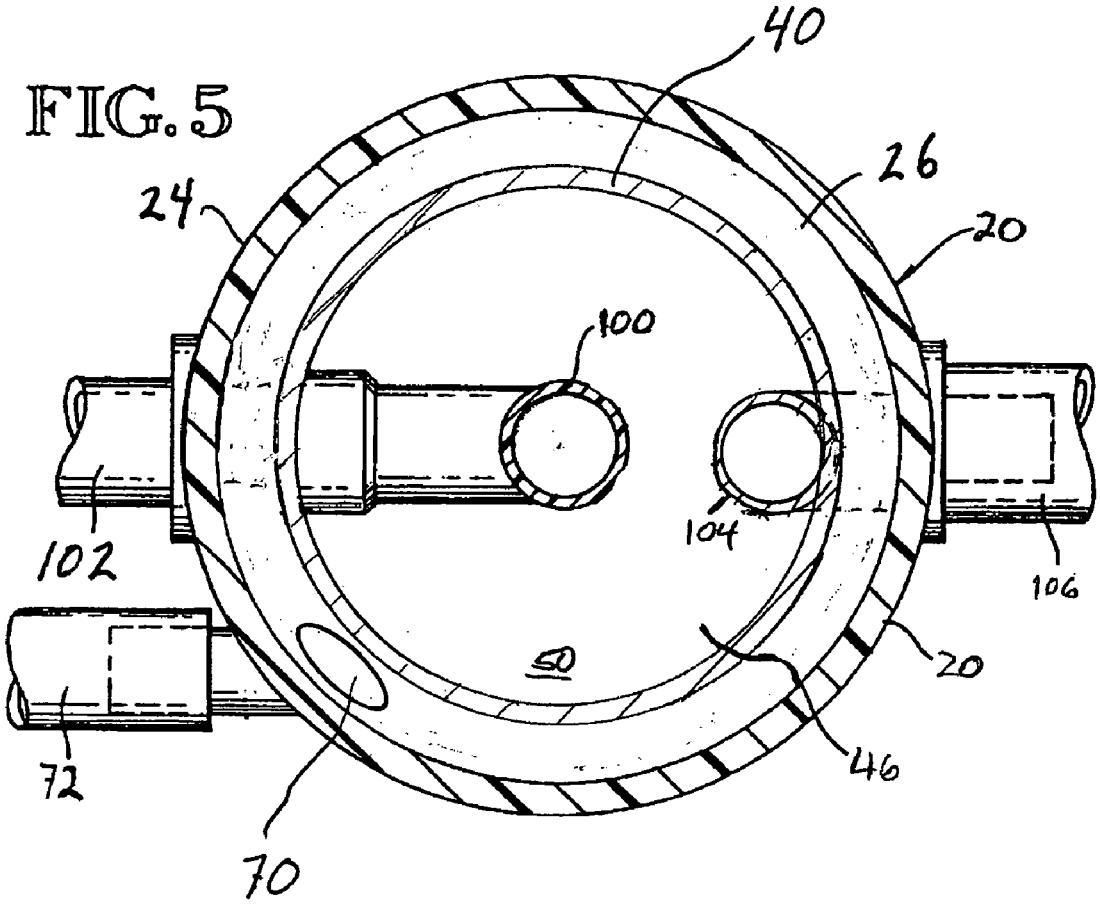
FIG. 5 is a transverse sectional view taken substantially along line 2—2 of FIG. 1.

As best seen in FIGS. 1 and 4, the upper end of the outer housing 20 may include a rounded transition wall 28 which curves from where its origin at side wall 24 to its termination at top 22. The inner surface of this transition wall is concave so that the helical fluid flow rising through the outer chamber 26 is not substantially disrupted as flows over side wall 44 of the inner housing 40, thence into inner chamber 46.

The top wall 22 of the outer housing 20 includes a gas vent 90 secured therein that has an upper end that vents to atmosphere and a lower end 94 that extends downwardly into the inner chamber 46. The gas vent 90 lower end 94 includes a conventional float body assembly 98 that permits the escape of excess gas, as is known to one of ordinary skill in the art.

Figure 3:
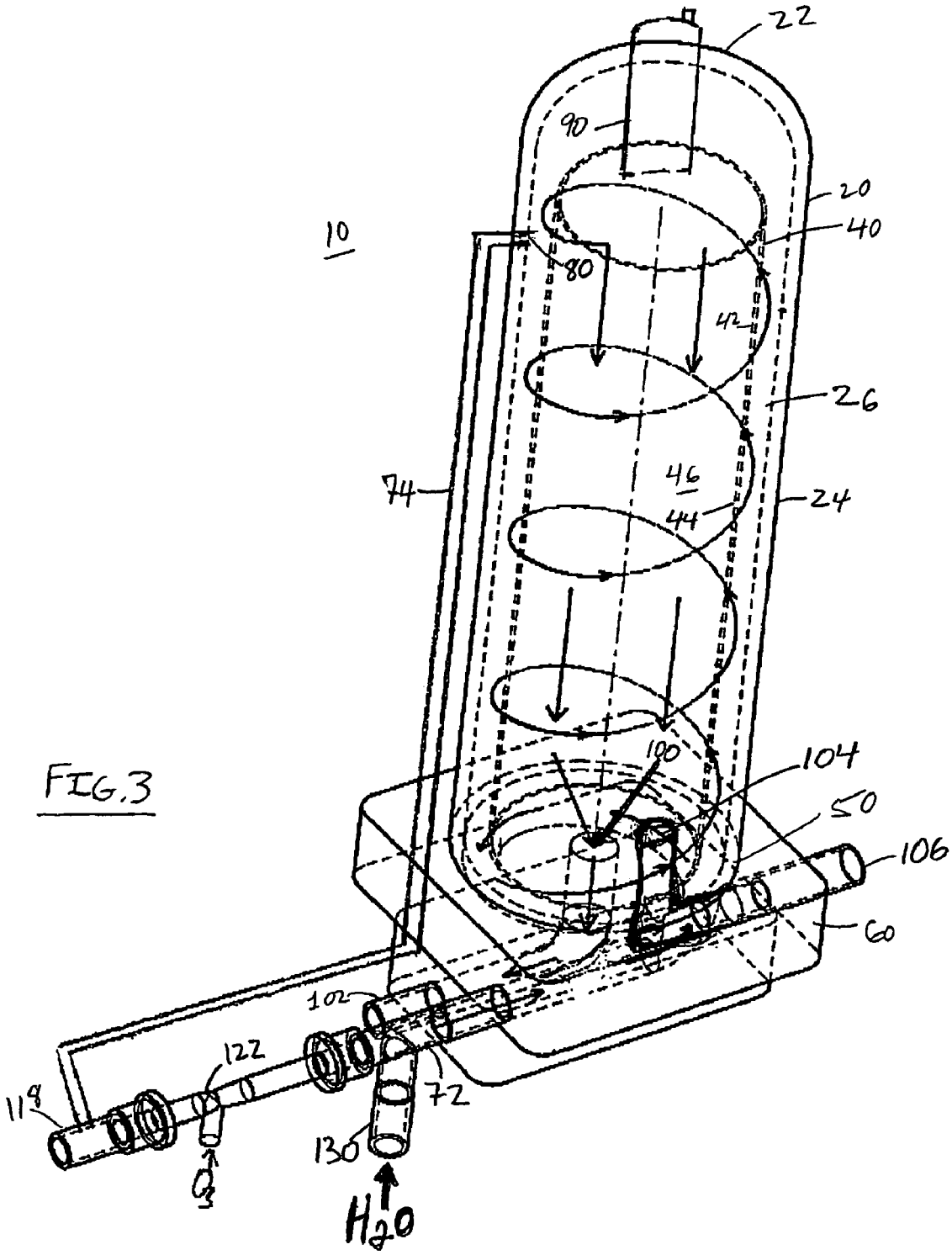
FIG. 3 is an isometric view of a liquid treatment system in accordance with one embodiment of the present invention.

Referring again to drawing FIGS. 1–3, a first fluid outlet 100 is disposed in the bottom 50 of the inner chamber 46 proximate the central axis thereof. The first fluid outlet 100 is in fluid communication with the inner chamber 46 and is used to withdraw a portion of fluid and gas containing larger gas bubbles from the center of the inner chamber 46 through a re-circulation conduit 102 thence back to, for example, a supply pump (not shown) for reintroduction to the system 10 through supply conduit 72.

A second fluid outlet 104 is disposed in the bottom 50 of the inner chamber 46 radially outwardly of the first fluid outlet 100, proximate the side wall 44 for withdrawing the mixed liquid and gas for end use through outlet conduit 106. The position of the second fluid outlet 104, being radially outwardly of the central axis in the bottom of said inner chamber 46 permits withdrawal of homogeneously mixed fluid and gas from the system 10, since the smaller gas bubbles in the mixture are forced radially outwardly towards side wall 44 by the helical current in said inner chamber 46.

In operation, re-circulated fluid flows through a conduit 118 into a venturi section of an ejector 122. There, it draws in new gas from a gas supply conduit 126. The new gas and the re-circulated fluid then flow into the supply conduit 72. Within the supply conduit 72, untreated liquid from conduit 130 is admixed with the gas and re-circulated liquid via a tee 132. The new mixture flows through supply conduit 72 into the inlet 70 to generate the helical current in the outer chamber 26. The gas manifests itself as small bubbles in the liquid. The helical current or vortex causes the fluid to enter into the lower region of the outer chamber 26 and form an upwardly directed helical current in this chamber. The swirling of the liquid and the gas in the chamber 26 promotes their mixture.

When the fluid mixture reaches the top of chamber 26, it flows through a passage 48 into the inner chamber 72. Flow rate through passage 48 increases in velocity because the cross sectional area of passage 48 is smaller than the cross sectional area of outer chamber 26. By way of typical example, the passage 48 may measure as small as 1/16th of an inch between the upper end edge and the closest portion of top end wall 42. The concave inner surface of the transition wall 28 changes the direction of fluid flow into a radially inward direction. The fluid then flows downwardly through into the main part of inner chamber 46 below the gas vent 90.

The downwardly directed swirling mixture draws down with it the gas bubbles that are entrained in the liquid. In the center of the inner chamber 46 the small bubbles combine to form large bubbles and then these large bubbles may move up and out through the gas vent 90. The secondary fluid inlet(s) 80 enhance the swirling action of the fluid and gas mixture. It has been observed that the inner chamber 46 promotes swirling currents that in turn promote gas and liquid mixing. It is also been observed that the small bubbles combine into large bubbles and leave the mixture through the gas vent 90.

Owing to an upward flow direction in the outer chamber 26 and a downward flow direction in the inner chamber 46, the outflow of liquid through the bottom 50 of the inner chamber 46 is assisted by gravity. The column of fluid within chamber 46 is pulled by gravity down towards the bottom 50 and the fluid outlets 100 and 104. The fluid that flows into outlet 100 proximate the center of the inner chamber flows out through the conduit 102 thence back to the pump or other pressurization means. The remainder of the flow exits through outlet 104 thence into outlet conduit 106.

The embodiments of the instant invention described herein above are illustrative examples of the present invention and, therefore, are not limiting. It is to be understood that many changes in the particular structure, materials and features of the present invention may be made without departing from the scope thereof.

I claim:

1. An apparatus for treating a liquid with a gas comprising:

a generally cylindrical outer housing having a top and a bottom;

a generally cylindrical inner housing having an open top and a bottom defining an inner chamber, said inner housing positioned substantially coaxially with and inside of said outer housing;

an outer chamber defined by a space between said inner and outer housings, said outer chamber in fluid communication with said inner chamber at the open top of said inner housing;

a first fluid inlet in fluid communication with said outer chamber at a lower portion thereof, said first fluid inlet positioned at an angle whereby fluid delivered therethrough is directed generally circumferentially into said outer chamber;

a first fluid outlet disposed in the bottom of said inner housing proximate the central axis thereof for withdrawing liquid to be re-circulated; and a second fluid outlet disposed in the bottom of said inner housing radially outwardly of said first fluid outlet for withdrawing a usable gas and liquid mixture.

2. An apparatus for treating a liquid with a gas as claimed in claim 1 further comprising:

a gas vent disposed in said inner chamber for venting excess gas through the top of said outer housing.

3. An apparatus for treating a liquid with a gas as claimed in claim 1 further comprising:

a secondary fluid inlet in fluid communication with said outer chamber at an upper portion thereof, said secondary inlet positioned at an angle whereby fluid delivered through the inlet is directed generally circumferentially into said outer chamber.

4. An apparatus for treating a liquid with a gas as claimed in claim 1 wherein said first fluid inlet is positioned at an angle whereby fluid delivered therethrough is directed generally circumferentially and upwardly into said outer chamber.

5. An apparatus for treating a liquid with a gas as claimed in claim 3 wherein said secondary fluid inlet is positioned at an angle whereby fluid delivered therethrough is directed generally circumferentially and upwardly into said outer chamber.

6. An apparatus for treating a liquid with a gas as claimed in claim 1 further comprising:

a plurality of secondary fluid inlets in fluid communication with said outer chamber at an upper portion thereof, said secondary inlets positioned at an angle whereby fluid delivered through the inlets is directed generally circumferentially into said outer chamber.

7. An apparatus for treating a liquid with a gas comprising:

a generally cylindrical outer housing having a top and a bottom;

a generally cylindrical inner housing having an open top and a bottom defining an inner chamber, said inner housing positioned substantially coaxially with and inside of said outer housing;

an outer chamber defined by a space between said inner and outer housings, said outer chamber in fluid communication with said inner chamber at the open top of said inner housing;

a first fluid inlet in fluid communication with said outer chamber at a lower portion thereof, said first fluid inlet positioned at an angle whereby fluid delivered therethrough is directed generally circumferentially into said outer chamber for delivering gas and liquid to said outer chamber;

a secondary fluid inlet in fluid communication with said inner chamber at an upper portion thereof, said secondary inlet positioned at an angle whereby fluid delivered therethrough is directed generally circumferentially into said inner chamber;

a first fluid outlet disposed in the bottom of said inner housing proximate the central axis thereof for withdrawing liquid to be re-circulated; and a second fluid outlet disposed in the bottom of said inner housing radially outwardly of said first fluid outlet for withdrawing a usable gas and liquid mixture.

8. An apparatus for treating a liquid with a gas as claimed in claim 7 further comprising:

a gas vent disposed in said inner chamber for venting excess gas through the top of said outer housing.

9. An apparatus for treating a liquid with a gas as claimed in claim 7 further comprising:

a plurality of secondary fluid inlets in fluid communication with said inner chamber at an upper portion thereof, said secondary inlets positioned at an angle whereby fluid delivered through the inlets is directed generally circumferentially into said outer chamber.

10. An apparatus for treating a liquid with a gas as claimed in claim 7 wherein said secondary fluid inlet is positioned at an angle whereby fluid delivered therethrough is directed generally circumferentially and downwardly into said inner chamber.

11. An apparatus for treating a liquid with a gas as claimed in claim 9 wherein said plurality of secondary fluid inlets are positioned at an angle whereby fluid delivered therethrough is directed generally circumferentially and downwardly into said inner chamber.

12. An apparatus for treating a liquid with a gas comprising:

a generally cylindrical outer housing having a top and a bottom;

a generally cylindrical inner housing having an open top and a bottom defining an inner chamber, said inner housing positioned substantially coaxially with and inside of said outer housing;

an outer chamber defined by a space between said inner and outer housings, said outer chamber in fluid communication with said inner chamber at the open top of said inner housing;

a first fluid inlet in fluid communication with said outer chamber at a lower portion thereof for delivering gas and liquid to said outer chamber;

a plurality of secondary fluid inlets in fluid communication with said outer chamber at an upper portion thereof and said inner chamber at an upper portion thereof, said secondary inlets positioned at an angle whereby fluid delivered therethrough is directed generally circumferentially into said outer and inner chambers;

a first fluid outlet disposed in the bottom of said inner housing proximate the central axis thereof for withdrawing liquid to be re-circulated; and a second fluid outlet disposed in the bottom of said inner housing radially outwardly of said first fluid outlet for withdrawing a usable gas and liquid mixture.

* * * * *